United States Patent [19]

Cartwright

[11] Patent Number: 4,669,339

[45] Date of Patent: Jun. 2, 1987

[54] REVERSIBLE WRENCH HAVING INSTANTANEOUSLY GRIPPING FRICTION DRIVE

[75] Inventor: Kenneth L. Cartwright, Lake Oswego, Oreg.

[73] Assignee: Constagrip, Inc., Portland, Oreg.

[21] Appl. No.: 848,918

[22] Filed: Apr. 7, 1986

Related U.S. Application Data

[63] Continuation of Ser. No. 628,796, Jul. 9, 1984, abandoned.

[51] Int. Cl.[4] ..... B25B 13/00; B25B 13/46

[52] U.S. Cl. ..... 81/59.1; 81/63.1

[58] Field of Search ..... 81/59.1, 63.1

[56] References Cited

U.S. PATENT DOCUMENTS

| | | | |
|---|---|---|---|
| 2,722,149 | 11/1955 | Henley | 81/59.1 |
| 3,362,267 | 1/1968 | Rozmus | 81/59.1 |
| 4,004,666 | 1/1977 | Hinojosa | 81/59.1 X |

*Primary Examiner*—Frederick R. Schmidt
*Assistant Examiner*—Maurina Rachuba
*Attorney, Agent, or Firm*—Chernoff, Vilhauer McClung & Stenzel

[57] ABSTRACT

The present invention is comprised of a handle having an enlarged head at one end with a cylindrical bore passing through it. A drive element rotatably located in the bore has three equally spaced planar cam faces which are separated by circular segments having a radius approximately equal to the radius of the bore. Elongate rollers which fit in the three semi-cylindrical portions of the bore remaining between the drive element and the periphery of the bore, have diameters which are approximately 0.002 less than the maximum distance between the cam faces and the periphery of the bore. A selector rotatably attached to the drive element has three pairs of prongs with one of the prongs in each pair being located on each side of a roller. A detent which is operative between the drive element and the selector causes the rollers to be completely wedged between the cam faces and the periphery of the bore when the selector head is rotated to either side of center and locks them in this wedged position during use. This is accomplished by providing balls on one of the elements and cavities on the other element which receives the balls a minimal amount intermediate their ends and more fully at their extremities with the balls being positioned at the extremities of the cavities when the rollers are in their fully wedged positions.

1 Claim, 5 Drawing Figures

REVERSIBLE WRENCH HAVING INSTANTANEOUSLY GRIPPING FRICTION DRIVE

This application is a continuation of application Ser. No. 628,796, filed Jul. 9, 1984, now abandoned.

BACKGROUND OF THE INVENTION

This invention relates to a wrench which is reversible to drive a socket in either direction while rotating freely in the opposite direction, and in particular to such a wrench which is driven through frictional engagement of rollers.

Clutch mechanisms utilizing frictional engagement of a plurality of rollers have long been used as the drive element of reversible wrenches in order to achieve essentially instantaneous engagement. Heretofore, such wrenches have had several shortcomings which have prevented their use from becoming wide spread in the market despite the inherent advantages they have over rachet-type wrenches.

Prior art wrenches of this type generally fall into two categories. Wrenches in the first category utilize one set of rollers for driving the wrench in the clockwise direction and another set for driving it in the counter-clockwise direction. This type of wrench is typified by Pratt, U.S. Pat. No. 2,469,572, and, due to the duplication of drive rollers, is expensive to fabricate. The other category of wrenches of this type, which includes the wrench of the present invention, uses the same rollers for both clockwise and counterclockwise rotation.

In order to achieve a good bite of the rollers, the prior art single-driving roller wrenches generally have arcuate cam faces such as those shown in Kounousky, U.S. Pat. No. 1,904,621, Freber, U.S. Pat. No. 2,119,622, and Richardson, U.S. Pat. No. 338,780. Where planer cam faces have been utilized, such as in Brown, U.S. Pat. No. 2,584,256, it has been in a four-roller system, which, due to its symmetry, has a tendency to become cocked.

In addition the prior art detents used to lock the wrenches in either their clockwise or counterclockwise direction of rotation have been in or out type of devices. Thus if the selector is not fully positioned, the wrench will not become engaged properly and slipage will occur.

SUMMARY OF THE INVENTION

The present invention overcomes the foregoing shortcomings and limitations of the prior art wrenches of this type by providing an elongate handle having at one of its ends an elongate cylindrical head with a cylindrical bore extending through it. An annular lip extends into the bore on one side of the head thereby making the diameter of the bore somewhat less over this portion. A drive element having the cross-sectional shape of a truncated equilateral triangle rotatably fits within the bore above the lip. Depending downwardly from the drive element is a rectangular stud of the type commonly used to carry sockets. Located in each of the three semi-cylindrical voids formed between the drive element and the periphery of the bore is an elongate roller whose diameter is approximately 0.002 inches less than the maximum distance between the cam face formed by each leg of the triangular drive element and the periphery of the bore. Thus, if the roller is moved a short distance laterally relative to the cam face, it becomes wedged between the cam face and the periphery of the bore. When this occurs, if the handle of the wrench is rotated in one direction the roller becomes further wedged and, as a result, the drive element is caused to rotate with it, and if the handle is rotated in the opposite direction the roller is forced out of its wedged position and the handle will rotate free of the drive element. Conversely, when the roller is moved to its wedged position at the opposite side of the cam face the handle then will be coupled to the drive element when it is rotated in the opposite direction.

Rotatably attached to the upper surface of the drive element is a direction selector which has three pairs of prongs. One pair of prongs extends into each of the semi-cylindrical voids with one of the prongs of each pair being located on both sides of an associated roller. Thus all of the rollers can be rotated simultaneously to their wedged positions by rotating the direction selector.

A detent associated with the direction selector ensures that it is moved to and remains in the position where the rollers are fully wedged each time the direction of the wrench is changed. The detent includes balls and springs which fit into openings located in the top of the drive head, and cavities which are located in the direction selector above the balls. The cavities are in the shape of back-to-back wedges the width and depth of which increases moving away from the point at which the two wedges are joined. Thus the balls project minimally into the cavities at their centers and further into the cavities moving outwardly from their centers in either direction. The balls and cavities are arranged in the wrench such that the former occurs when the rollers are located medially on the cam faces and the latter occurs when they are in their fully wedged positions.

Accordingly, it is a principal objective of the present invention to provide a reversible friction driven roller wrench which has three rollers that engage planer cam faces.

It is a further object of the present invention to provide such a wrench which requires a minimal number of parts.

It is a still further object of the present invention to provide such a wrench in which the rollers are fully moved to their driving positions when the direction of rotation has changed.

It is a further object of the present invention to provide such a wrench in which the rollers are continuously held fully in their driving positions after having been initially placed there.

The foregoing and other objectives, features and advantages of the present invention will be more readily understood upon consideration of the following detailed description of the invention, taken in conjunction with the accompanying drawings.

PREFERRED EMBODIMENT OF THE INVENTION

Figure 3:
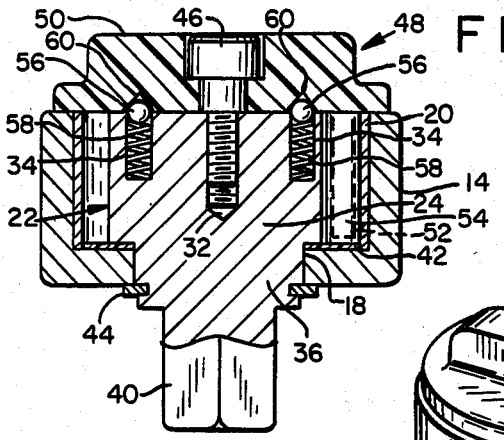
FIG. 3 is a sectional view taken on the line 3—3 of FIG. 2, partially broken away to show hidden detail.
Figure 1:
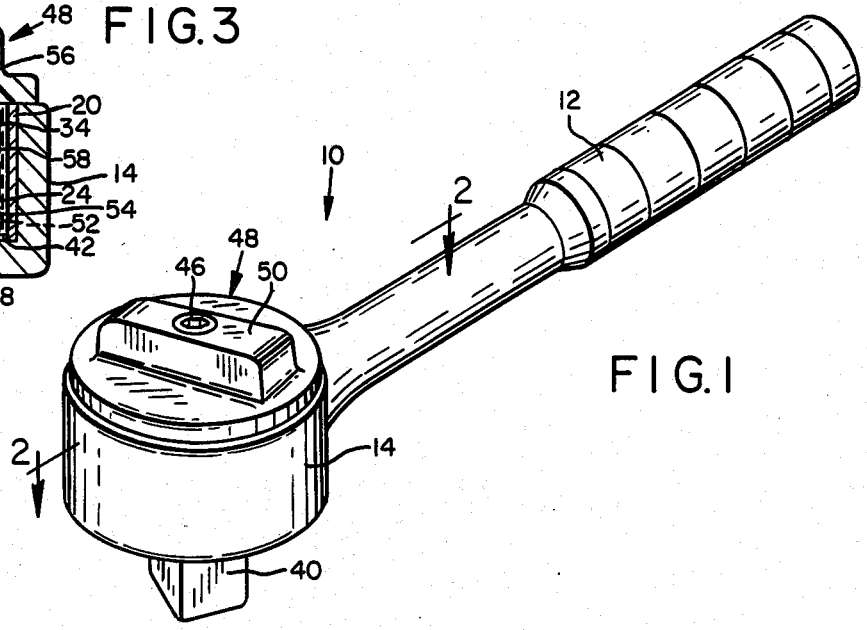
FIG. 1 is a perspective view of a wrench embodying the features of the present invention.
Figure 5:
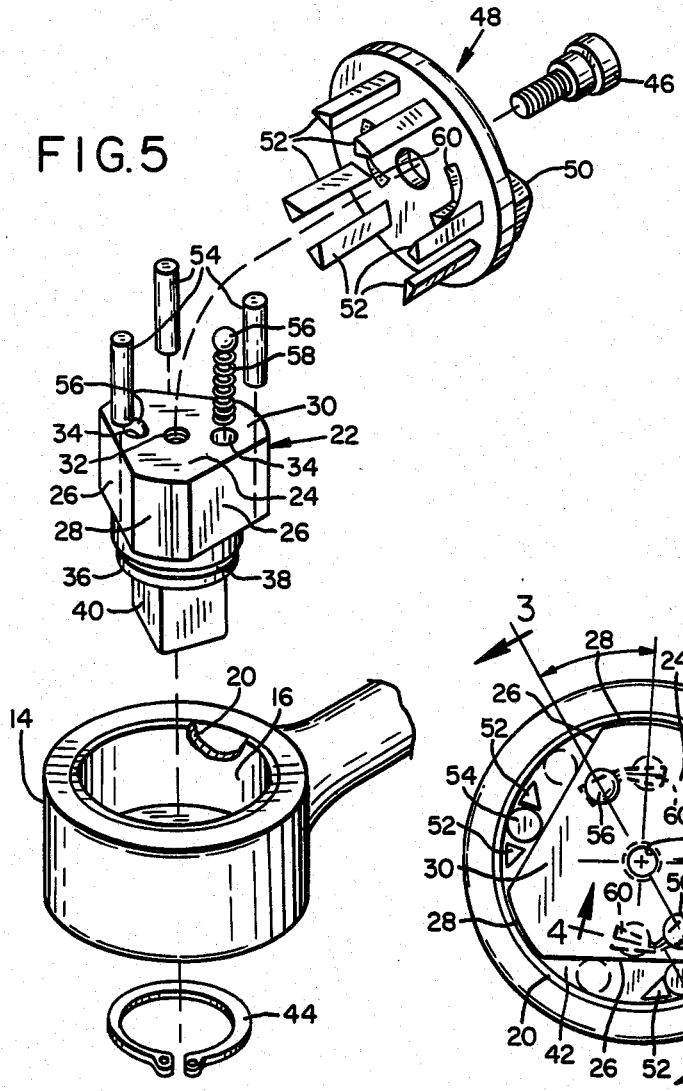
FIG. 5 is a fragmentary exploded pictorial view of the wrench of FIG. 1.
Figure 4:
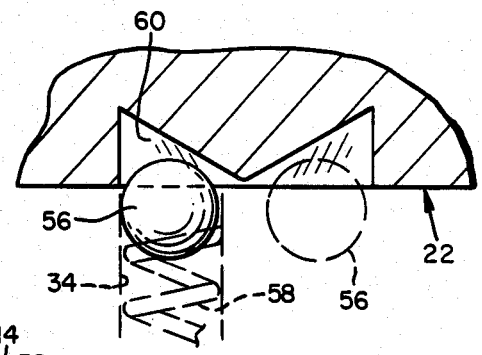
FIG. 4 is a fragmentary sectional view taken on the line 4—4 of FIG. 2.
Figure 2:
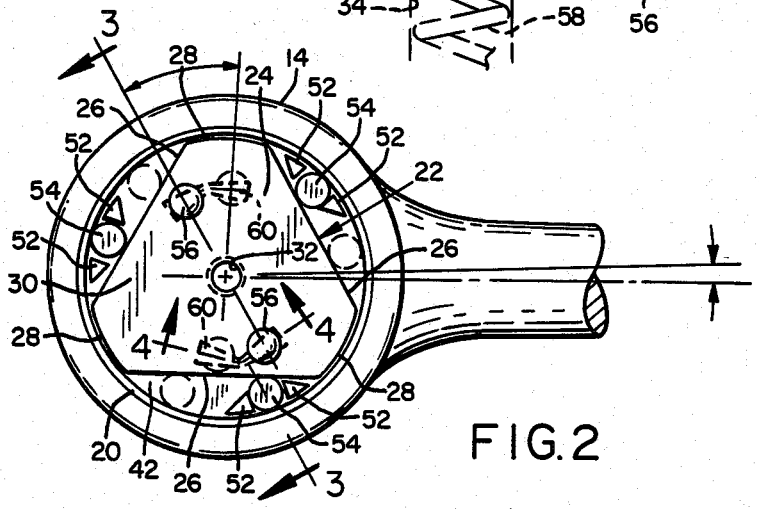
FIG. 2 is a fragmentary sectional view taken on the line 2—2 of FIG. 1, showing portions of the wrench in an alternate operable position in dashed lines.

Referring to the drawings, the wrench of the present invention includes a handle 10 having a gripping surface 12 at one end and an enlarged cylindrical head 14 at the other end. Extending through the head is a cylindrical bore 16. An annular lip 18 protrudes from the head into the bore on one side of the head, thereby making the diameter of the bore less in this region. In the embodiment illustrated a sleeve 20, preferably having a Rockwell hardness between 62 and 63, is pressed into that portion of the bore lying above the lip 18. Optionally the inner periphery of the bore could be hardened to serve as the wear surface, however, a sleeve is replaceable and thus allows the wrench to be repaired when wear does occur.

Rotatably located in the bore 16 is a drive element 22 which, in the embodiment illustrated, has a body 24 having the cross-sectional shape of a truncated equilateral triangle and a height approximately equal to the depth of the bore 16 lying above the lip 18. Thus the body has three rectangular cam faces 26 located at equal angles from one another around its periphery. The truncated apices 28 of the drive element are circular segments having a radius which preferably is approximately 0.002 inches less than the radius of the inner surface of the sleeve 20. Located centrally in the top surface 30 of the cam element is a threaded hole 32 and two detent spring bores 34 are located outwardly of the hole 32 on a common radius.

A cylindrical journal segment 36 having approximately the same diameter as that portion of the bore 20 defined by the lip 18 extends downwardly from the body of the drive element, and a peripheral keeper groove 38 is located near the lower end of this journal segment. A rectangular socket drive stud 40 extends outwardly from the journal segment for receiving a standard socket. A wear ring 42 fits in the bore 16 between the lip 18 and the drive element, and a snap ring 44 fits into the keeper groove 38 to hold the drive element in place in the head. The cam faces 26 of the drive element 22 preferably have the same Rockwell 62–63 hardness as the sleeve 20, which is achieved in the preferred embodiment of the invention by fabricating the entire drive element out of "bearcat" material.

Located above the drive element and rotatably attached to it by means of a screw 46 is a direction selector 48. In order to provide proper resilience and wear characteristics, the direction selector preferably is injection molded from a plastic material such as a nylon 6—6 30% glass filled. The direction selector includes a thin cylindrical cover 48 which has a diameter slightly less than the diameter of the head 14. A raised tang 50 on top of the cover facilitates rotation of the direction selector. Depending downwardly from the cover are three equally-spaced sets of prong pairs 52 one of which fits into the bore adjacent to each cam face 26. Located between each pair of prongs 52 is an elongate roller 54 which has a diameter which is approximately 0.002 inches less than the distance between the cam faces 26 and the inner periphery of the insert 20. Preferably the rollers have slightly less hardness than the sleeve 20 and the drive element 24 and in the embodiment illustrated they have a Rockwell hardness of 60–61.

Since the prongs in each pair are separated by a distance which is approximately equal to the diameter of the rollers, when the direction selector is rotated relative to the drive element the rollers are moved laterally across the cam faces along with it. However, the direction selector can only be rotated in one direction until the rollers become jammed between the cam faces and the sleeve. When this occurs upon clockwise rotation of the direction selector, rotation of the handle in a clockwise direction causes the rollers to become more tightly wedged thereby coupling the handle rotatably with the drive element and thus the socket drive stud 40. However, counter-clockwise movement of the handle frees the rollers thereby allowing the handle to rotate freely with respect to the drive element. Likewise, when the direction selector is rotated counter-clockwise until the rollers become wedged, the handle becomes coupled with the drive element for counter-clockwise rotation and is free for clockwise rotation.

In order to ensure that the direction selector has been positioned at its full rotational limits and is held there during the use of the wrench, detents are provided between the direction selector and the drive element. In the embodiment illustrated the detents include springs 56 and balls 58 which fit into the bores 34. The balls are urged out of the bores into cavities 60 located in the lower surface of the cover 48 across from the balls. Each cavity generally provides back-to-back wedges Whose apices meet at the center of the cavity and whose depth and width increase moving away from the center.. Thus the balls project into the cavities a minimum amount when they are at their center, which is arranged to occur when the rollers are at the middle of their respective cam faces, and a maximum amount when they are at either of their extremities, which occurs when the rollers become jammed between the side of their respective cam faces and the sleeve. Thus once rotation of the direction selector is initiated in either direction the springs 56 will force the balls into the deepest portion of the cavities and thus cause the direction selector to be rotated to its limit in that direction, insuring that the wrench will be engaged for driving.

The terms and expressions which have been employed in the foregoing description and used therein as terms of description and not of limitation, and there is no intention in the use of such terms and expressions of excluding equialents of the features shown and described or portions thereof, it being recognized that the scope of the invention is defined and limited only by the claims which follow.

What is claimed is:

1. A reversible friction drive wrench comprising:

(a) a handle having an enlarged head at one end, said head defining a cylindrical bore therein;

(b) a drive element rotatably located within said bore;

(c) said drive element having a truncated, equilateral triangular cross-sectional shape with planar cam faces located on each leg of said triangle;

(d) the truncated apices of said drive element being circular segments having a radius which is slightly less than the radius of said bore;

(e) three rollers, one being associated with each of said cam faces, said rollers having diameters which are less than the distance between the cam faces and the periphery of said bore;

(f) selector means rotatably attached to said drive element for positioning said rollers as a group at desired locations on said cam faces; and (g) detent means operable between said reflector means and said drive element for retaining said selector means irrotatable relative to said drive element when said rollers are offset on said cam faces to positions where they are in simultaneous contact with said cam faces and said periphery wherein said detent means comprises at least one ball associated with one of said selector means and said drive element; a like number of cavities located in other of said selector means and said drive element, said cavities being positioned opposite said balls; the width of said cavities becoming progressively larger extending in either direction form the midpoints thereof; the depth of said cavities becoming progressively larger extending in either direction from the midpoints thereof; spring means, associated with each of said balls, for urging said balls towards said cavities; and said cavities being positioned relative to said balls such that said balls are located medially between the midpoints and one of the extremities of said cavities when said rollers are positioned in simultaneous contact with said cam faces and said periphery.

* * * * *

UNITED STATES PATENT AND TRADEMARK OFFICE

CERTIFICATE OF CORRECTION

PATENT NO. : 4,669,339

DATED : June 2, 1987

INVENTOR(S) : Kenneth L. Cartwright

It is certified that error appears in the above-identified patent and that said Letters Patent is hereby corrected as shown below:

In the Abstract, after "0.002" insert --inches--.

| | | |
|---|---|---|
| Col. 1, | Line 37 | Change "planer" to --planar--; |
| | Line 46 | Change "slipage" to --slippage--. |
| Col. 2, | Line 38 | Change "planer" to --planar--. |
| Col. 4, | Line 8 | After "center" delete --.--; |
| | Line 44 | Change "equialents" to --equivalents--; |
| | Line 66 | Change "reflector" to --selector--. |
| Col. 5, | Line 7 | After "in" insert --the--; |
| | Line 10 | Change "form" to --from--. |

Signed and Sealed this

Fifth Day of January, 1988

*Attest:*

DONALD J. QUIGG

*Attesting Officer*

*Commissioner of Patents and Trademarks*